US007187331B2

(12) United States Patent
Chen et al.

(10) Patent No.: US 7,187,331 B2
(45) Date of Patent: Mar. 6, 2007

(54) EMBEDDED MULTIBAND ANTENNAS

(75) Inventors: Zhi Ning Chen, Singapore (SG); Brian P. Gaucher, Brookfield, CT (US); Duixian Liu, Yorktown Heights, NY (US)

(73) Assignee: Lenovo(Singapore) Pte, Ltd., Singapore (SG)

( * ) Notice: Subject to any disclaimer, the term of this patent is extended or adjusted under 35 U.S.C. 154(b) by 0 days.

(21) Appl. No.: 10/967,408

(22) Filed: Oct. 18, 2004

(65) Prior Publication Data

US 2006/0082504 A1 Apr. 20, 2006

(51) Int. Cl.
*H01Q 1/24* (2006.01)

(52) U.S. Cl. ..... 343/702; 343/846

(58) Field of Classification Search ..... 343/700 MS, 343/702, 895, 846

See application file for complete search history.

(56) References Cited

U.S. PATENT DOCUMENTS 6,700,541 B2 * 3/2004 Konishi ..... 343/700 MS
6,946,997 B2 * 9/2005 Yuanzhu ..... 343/700 MS
2004/0056805 A1 * 3/2004 Chen ..... 343/700 MS

* cited by examiner

*Primary Examiner*—Hoang V. Nguyen
(74) *Attorney, Agent, or Firm*—Ronald V. Davidge; Carlos Munoz-Bustamante

(57) ABSTRACT

A compact sized embedded, multiband, multi-standard, interoperable antenna for portable devices used in wireless applications is provided. The antenna design includes an asymmetrical structure provided on a double-sided printed circuit board. The asymmetrical structure covers both the ultra-wideband and the wireless local area network band. The asymmetrical structure provided on the front side of the printed circuit board is a primary radiator with a supplement strip radiator, whereby the bottom of the primary radiator is close to the vertical ground plane and fed by a probe extended from a coaxial line. The asymmetrical structure on the front side provides a well-matched bandwidth covering the ultra-wideband band of 3.1 GHz to 10.6 GHz. A second supplement strip is provided on the backside of the printed circuit board which provides the second resonance at the 2.4 GHz wireless local area network band.

15 Claims, 5 Drawing Sheets

EMBEDDED MULTIBAND ANTENNAS

TECHNICAL FIELD OF THE INVENTION

The present invention relates generally to embedded antennas for portable devices used in wireless applications, and more specifically, to multiband antennas that may be embedded in portable devices such as laptop computers and cellular phones, for example, to provide efficient wireless communications.

BACKGROUND

In wireless communication, antennas may be used to provide wireless connectivity between a portable device, such as a laptop computer, and other portable devices, peripherals, or communication devices. In a portable laptop computer, the antenna may be located either external to the computer or integrated within the computer.

FIG. 1 shows an exemplary embodiment of a laptop computer which includes one or more antennas integrally built, or embedded, within the laptop computer. As shown in FIG. 1, the laptop computer 100 includes one or more antennas 110, 120, 130, such as whip-like or slot embedded antennas, embedded in a laptop display 150. In one exemplary embodiment, two embedded antennas 110 and 120 may be placed on the left and right edges of the laptop display 150, respectively, whereby the use of the two antennas 110 and 120 may reduce the blockage caused by the laptop display 150 in some directions that occurs in one antenna system design, and provide space diversity to the wireless communication system. Alternatively, one of the antennas 110 or 120 may be disposed on one side of the laptop display 150 while a second antenna 130 is disposed in an upper portion of the laptop display 150, whereby providing antenna polarization diversity, depending on the antenna design used.

SUMMARY OF THE INVENTION

In accordance with the various exemplary embodiments of this invention, a compact sized embedded, multiband, multi-standard, interoperable antenna for portable devices used in wireless applications is provided.

More specifically, the various exemplary embodiments of this invention include multiband antennas that may be embedded in portable devices such as laptop computers and cellular phones, for example.

In accordance with various exemplary embodiments of this invention, the asymmetrical structure covers both the ultra-wideband and the wireless local area network band.

In accordance with various exemplary embodiments of this invention, the antenna design includes an asymmetrical structure and a vertical ground plane.

In accordance with various exemplary embodiments of this invention, the asymmetrical structure is provided on a double-sided printed circuit board.

In accordance with these various exemplary embodiments, the asymmetrical structure includes a front portion provided on the front side of the printed circuit board.

In various exemplary embodiments of this invention, the front portion of the asymmetrical structure includes a primary portion with an supplement strip portion attached thereto.

In these exemplary embodiments, the bottom of the primary portion is close to the vertical ground plane and fed by a probe extended from a coaxial line.

In these exemplary embodiments, the front portion of the asymmetrical structure provides a well-matched bandwidth covering the ultra-wideband band of 3.1 GHz to 10.6 GHz.

In accordance with various exemplary embodiments of this invention, the asymmetrical structure includes a second supplement strip provided on the backside of the printed circuit board which provides the second resonance at the 2.4 GHz wireless local area network band.

In accordance with these exemplary embodiments, the front portion of the asymmetrical structure is connected to the second supplement strip provided on the backside by a top portion.

These and other exemplary embodiments, objects, embodiments, features and advantages of this invention will be described or become apparent from the following detailed description of preferred embodiments, which is to be read in connection with the accompanying drawings.

BRIEF DESCRIPTION OF THE DRAWINGS

FIGS. 3A–D schematically illustrate an exemplary multiband antenna mounted on a laptop display unit according to various exemplary embodiments of this invention, wherein FIG. 3A shows the front view of the antenna on the display unit, FIG. 3B shows the back view of the antenna on the display unit, FIG. 3C shows the top view of the antenna on the display unit, and FIG. 3D shows the side view of the antenna on the display unit.

FIGS. 4A–B show exemplary embodiments provided to achieve good resonance in multiband, multi-standard, interoperable applications, wherein FIG. 4A shows an exemplary embodiment of an antenna in a 3.1 GHz to 10.6 GHz ultra-wideband application and FIG. 4B shows an exemplary embodiment of an antenna in a 2.4 GHz wireless local area network application.

DETAILED DESCRIPTION OF EXEMPLARY EMBODIMENTS

Figure 1:
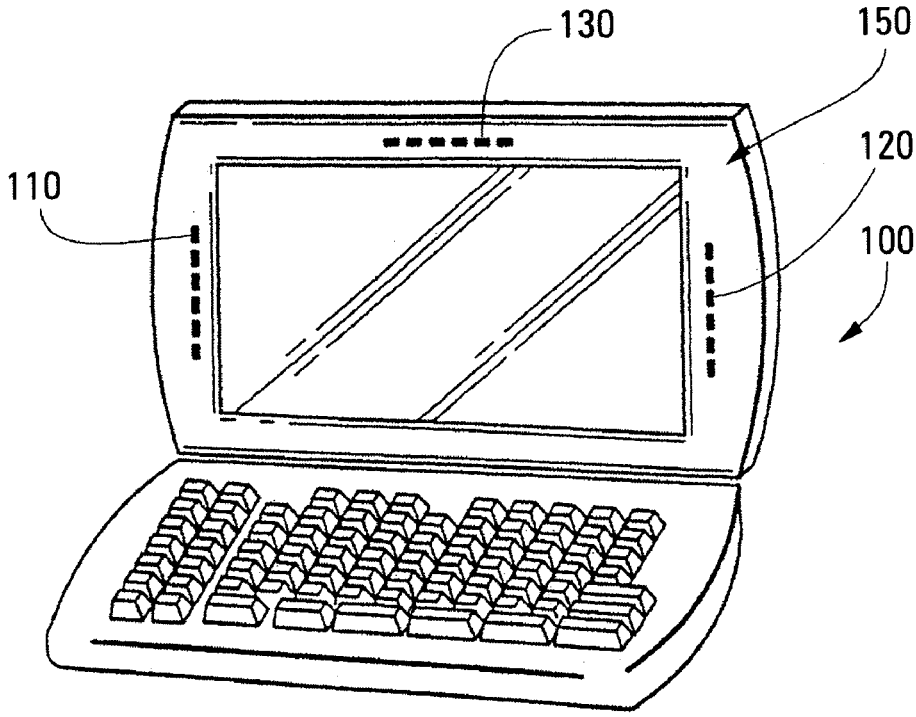
FIG. 1 is a diagram illustrating various embodiments of embedded antennas for a laptop computer.

In recent developments, embedded antennas may be mounted on a metallic support frame or rim of a display device of a laptop computer, such as the liquid crystal display (LCD) panel, or other internal metal support structure, as well as antennas that may be integrally formed on the shielding foil located on the back of the display unit. For example, U.S. Pat. No. 6,339,400, issued to Flint et al. on Jan. 15, 2002, entitled "Integrated Antenna For Laptop Applications", and U.S. patent application Ser. No. 09/876,557, filed on Jun. 7, 2001, entitled "Display Device, Computer Terminal and Antenna," which are commonly assigned and incorporated herein by reference, disclose various embedded single-band antenna designs for laptop computers, which may be implemented to operate in the 2.4 GHz ISM frequency band, for example. Furthermore, U.S. patent application Ser. No. 09/866,974, filed on May 29, 2001, entitled "An Integrated Antenna for Laptop Applications", and U.S. patent application Ser. No. 10/370,976, filed on Feb. 20, 2003, entitled "An integrated Dual-Band Antenna for Laptop Applications," both of which are commonly assigned and incorporated herein by reference, describe embedded dual-band antennas for laptop computers that may be implemented to operate in the 2.4 GHz ISM band and 5.15–5.35 GHz bands, for example. In addition, U.S. patent application Ser. No. 10/318,816, filed on Dec. 13, 2002, entitled "An Integrated Tri-Band Antenna for Laptop Applications", which is commonly assigned and incorporated herein by reference, discloses various embedded tri-band antennas for laptop computers that may be implemented to operate in the 2.4–2.5 GHz, 5.15–5.35 GHz and 5.47–5.85 GHz bands, for example.

Antennas may be designed by patterning one or more antenna elements on a printed circuit board, and then connecting the patterned printed circuit board to the metal support frame of the display panel, wherein the metal frame of the display unit may be used as a ground plane for the antennas. A coaxial transmission line may be used to feed the embedded antenna, wherein the center conductor is connected to a radiating element of the antenna and the outer ground connector is connected to the metal rim of the display unit.

In designing multiband frameworks, the space required for optimum antenna designs, the materials the antennas reside in or behind, and the space typically available within the portable device, for example, are considered. For embedded solutions, the antenna resides within the portable device, underneath the plastic, composite or metal covers. Thus, the user never needs to know that the antenna is present. Further, because the antenna resides underneath, the possibility of accidental breakage is reduced in these embedded designs.

In designing the portable devices, such as laptop computer designs, the size is severely limited, and any additional antenna needs to fit within the confines of the laptop computer. Usually, the available thickness is less than 2 mm, and the height varies from 5 mm to 10 mm, depending upon the types of laptop covers. Due to the reduced space required for optimal designs, and being integrally built within semi-conducting or conducting materials and the proximity effect of the metallic laptop cover and/or display, embedded antennas usually do not perform as well as external antennas. To achieve acceptable performance of an embedded antenna, the commonly used method is to keep the antenna away from any metal component of the laptop computer. Depending on the design of laptop computers and type of antennas, the distance between an antenna and the metal components is preferably larger than 10 mm. Many antenna types, such as slot antennas, inverted-F antennas and notch antennas, provide advantages including small antenna size, low cost manufacturing, minimum effects on industrial design, and reliable performance.

Ultra-wideband wireless systems covering 3.1 GHz to 10.6 GHz are used to increase data rate for indoor, short-range, low-power wireless communications or localization systems as next generation wireless communication technology. Using ultra-wideband technology, the wireless communication systems may transmit and receive signals with more than 100% bandwidth with low transmission power of typically less than −41.3 dBm/MHz. Thus, the antennas for ultra-wideband systems may maintain high performance as measured by gain and impedance match, horizontally omni-directional radiation.

Accordingly, it would be advantageous to add the ultra-wideband connectivity to the laptop computer designes, and thus, enabling simultaneous use of wireless local area network and the ultra-wideband connectivity in the same laptop computer. However, the addition of yet another antenna may increase the already over burdened space constraints within the laptop computer. That is, typically, broad band antenna designs require even more space than the relatively narrow band designs used in wireless local area network, for example. Thus, the antennas for the ultra-wideband systems should also be small in size to meet the requirements for portable devices such as laptop computers.

In accordance with the various exemplary embodiments of this invention, a small-sized multiband antenna is provided that covers multiple standards such as wireless local area network, including the well-known Bluetooth applications, and ultra-wideband applications.

The exemplary embodiments of the present invention aim at multiband and multi-standard antenna designs for portable devices such as laptop computers. The various exemplary embodiments of this invention cover the wireless local area networks across the 2.4 GHz band and the 3.1 GHz–10.6 GHz band in ultra-wideband applications.

In wireless local area network systems, there may be at least two antennas provided to ameliorate the deleterious effects of multi-path and fading as well as any blockage the liquid crystal display screen might cause. As an example, there may be two antennas in the liquid crystal display, one on the left and right side or possibly the top. The different locations may also be utilized to reduce effects due to polarization if the designs are appropriate.

Figure 2:
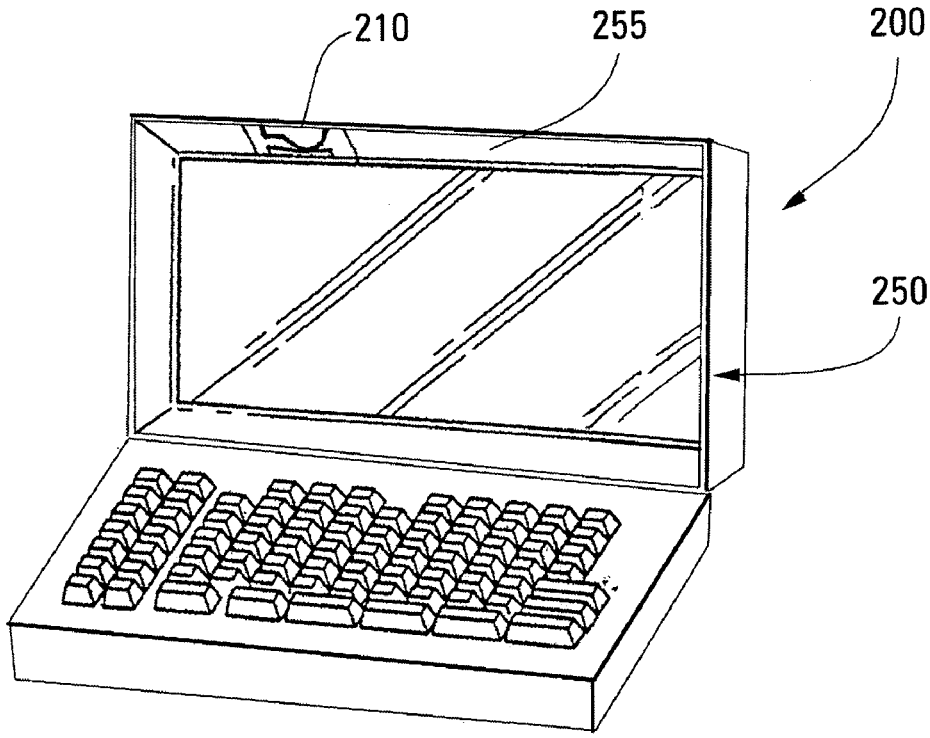
FIG. 2 is a schematic diagram illustrating a method for mounting an embedded antenna on a laptop display unit in accordance with various exemplary embodiments of this invention.

FIG. 2 is a schematic diagram illustrating various orientations for mounting embedded antennas on a laptop display unit, as well as multiband antenna frameworks in accordance with the exemplary embodiments of this invention. For example, FIG. 2 shows a laptop computer 200 including a laptop display unit 250 and a multiband antenna 210 mounted on a metal or plastic support frame 255 of the laptop display unit 250. As shown in FIG. 2, the multiband antenna 210 is mounted to the support frame 255, wherein the plane of the multiband antenna 210 is substantially parallel to the plane, or along the plane, of the support frame 255.

It should be appreciated that the display frame, support frame or the shielding foil on the back of the display may be part of the antenna.

In the various exemplary embodiments of this invention, multiband antenna performance is achieved by minimizing the required height of a radiator for the ultra-wideband band and providing another radiator for the 2.4 GHz wireless local area network band.

FIGS. 3A–D show an exemplary multiband antenna mounted on a laptop display unit according to the various exemplary embodiments of this invention. As shown in FIGS. 3A–D, a multiband antenna 300 is implemeted on a printed circuit board substrate 310 connected to a horizontal ground plate 370.

As shown in FIGS. 3A–D, the multiband antenna 300 is implemented on both sides of the double-sided printed circuit board substrate 310. The multiband antenna 300 includes an asymmetrical structure 320 and a vertical ground plane 350, wherein the vertical ground plane 350 is provided on the front side 312 of the printed circuit board substrate 310, and the asymmetrical structure 320 is provided on a front side 312 and backside 314 of the printed circuit board substrate 310.

In accordance with various exemplary embodiments of this invention, the asymmetrical structure 320 covers both the ultra-wideband and the wireless local area network band.

Figure 3A:
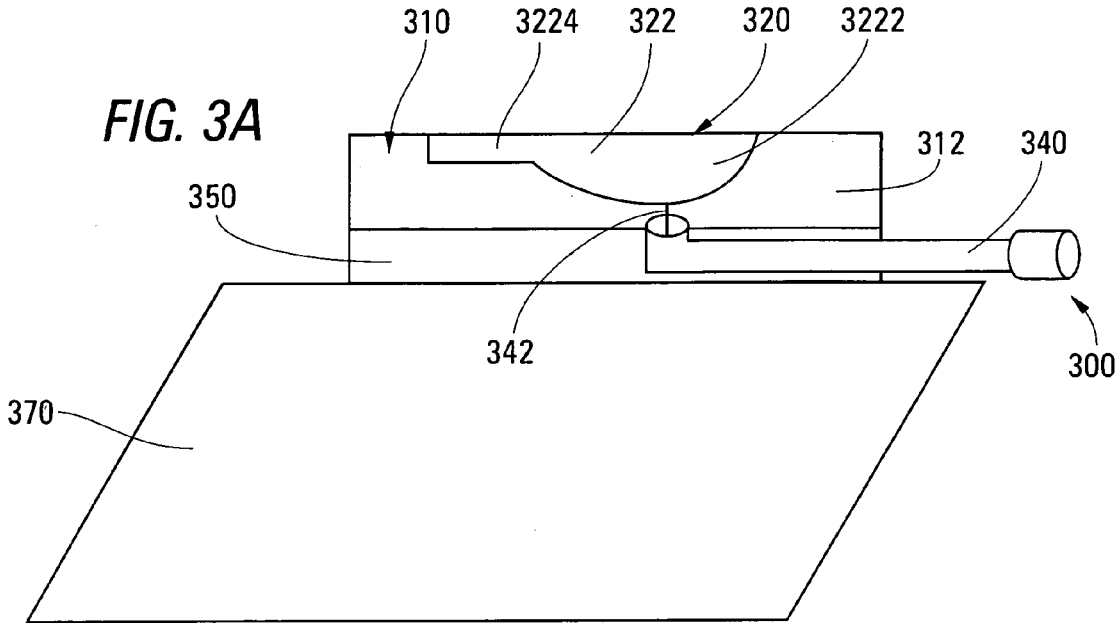

As shown in FIG. 3A, a front portion 322 of the asymmetrical structure 320 is provided on the front side 312 of the printed circuit board substrate 310. The front portion 322 includes a primary portion 3222 with a frontside strip portion 3224 attached thereto. In the exemplary embodiment shown in FIG. 3A, the primary portion 3222 is semi-elliptical in shape, however, it should be appreciated that the various exemplary embodiments of this invention are in no way limited to this shape.

As shown in FIG. 3A, the bottom of the primary portion 3222 is close to the vertical ground plane 350 and is fed by a feed probe 342, or inner conductor of a coaxial line 340, extending from the coaxial line 340. As shown in the figure, the vertical ground plane 350 is a finite-size ground plane provided parallel to the printed circuit board substrate 310. It should be appreciated that the coaxial line 340 may be a feeding cable having an outer conductor, or shield, soldered onto the vertical ground plane 350 such that it is electrically connected to the vertical ground plane 350. Further, it should be appreciated that the size of the vertical ground plane 350 may have a slight effect on the impedance matching.

In accordance with the various exemplary embodiments of this invention, the front portion 322 provided on the frontside 312 provides a well-matched bandwidth covering the ultra-wideband band of 3.1 GHz to 10.6 GHz.

In various exemplary embodiments of this invention, the multiband antenna 300 does not use the laptop display as a part of the ground plane. In these exemplary embodiments, the horizontal ground plane 370 is used to provide additional ground to the vertical ground plane 350 described above. It should be appreciated that, in these exemplary embodiments, the horizontal ground plane 370 is thin so that it can be provided between the laptop display unit and the laptop cover. As shown in FIG. 3A, the angle between the horizontal ground plane 370 and the vertical ground plane 350 is about 90 degrees.

Figure 3B:
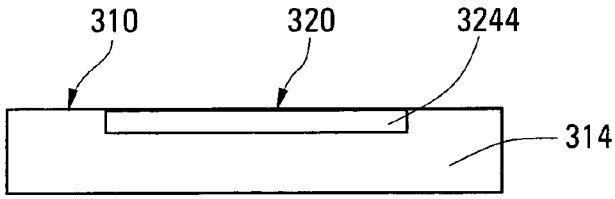

As shown in FIG. 3B, the asymmetrical structure 320 includes a backside strip portion 3244 provided on the backside 314 of the printed circuit board substrate 310. In accordance with these exemplary embodiments, the backside strip portion 3244 provides resonance at the 2.4 GHz wireless local area network band.

Figure 3C:
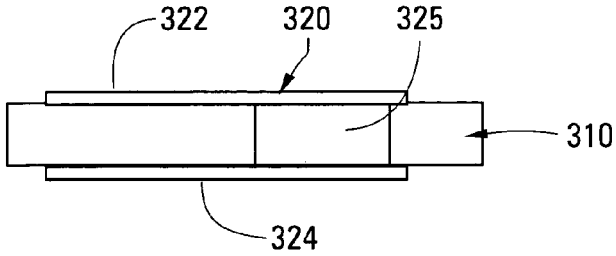
Figure 3D:
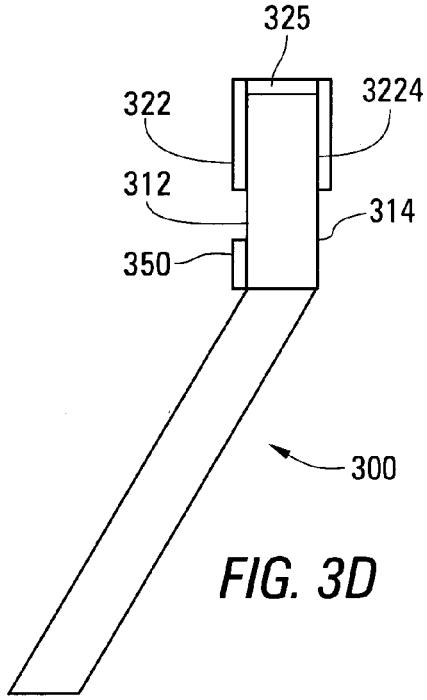

As shown in FIGS. 3C–D, the asymmetrical portion 320 further includes a top portion 325, wherein the front portion 322 and the backside strip portion 3244 are partially connected by the top portion 325 on the printed circuit board substrate 310.

In the various exemplary embodiments of this invention, multiband antenna performance is achieved by adding the frontside strip portion 3224 to the primary portion 3222 to minimize required height for the 3.1 GHz to 10.6 GHz ultra-wideband applications, and providing the backside strip portion 3244 for the 2.4 GHz wireless local area network applications.

As shown in FIGS. 3A–D, the backside strip portion 3244 is provided in parallel with the frontside strip portion 3224, and is provided with the same height.

It should be appreciated that the rigorous laptop space constraints may be met by these exemplary embodiments, whereby a multiband antenna having a small profile with low height and thin width is provided at low cost. It should also be appreciated that the exemplary embodiments of this invention satisfy multiple standards by covering both the 2.4 to 2.5 band and the 3.1 GHz to 10.6 GHz ultra-wideband band, with acceptable gain and omni-directional radiation in horizontal planes with a single feed point. Furthermore, it should be appreciated that the exemplary embodiments of this invention cover other two wireless local area network bands of 5.15 GHz to 5.35 GHz and 5.47 GHz to 5.825 GHz as well.

In one exemplary implementation, the antenna is etched onto a 13 mm×45 mm×20 mil 25N Arlon printed circuit board substrate with dielectric constant of 3.38 and 0.0025 loss tangent at 10 GHz. In this exemplary implementation, the ground plane surface is in contact with the metal laptop display cover and a cable outer conductor, and the antenna is installed at the top of the cover. The frame grill of the cover has a height of 12 mm on the inside and a slant of about 10 degrees. A feed cable of a length of 21 mm is installed along the frame of the display. The minimum distance between the frame of the display to the bottom of the antenna is about 3 mm. The thickness of the display is about 5 mm. The top of the antenna is 1 mm high over the frame of the cover.

It should be appreciated that the above-described exemplary implementation is merely an exemplary embodiment described to better understand the various embodiments of this invention, and that the various embodiments of this invention is not limited to such implementation in any way.

In the various exemplary embodiments of this invention, the multiband antennas provide the flexibility needed in wireless communication. Those of ordinary skill in the art will readily appreciate that the size, shape, and/or positioning of the various antenna elements will vary depending on, for example, the type of components used to construct the antennas such as the wires, planar metal strips, printed circuit board, and the like, the antenna environment, the available space for the antenna, and the relative frequency bands when used for different applications.

Figure 4A:
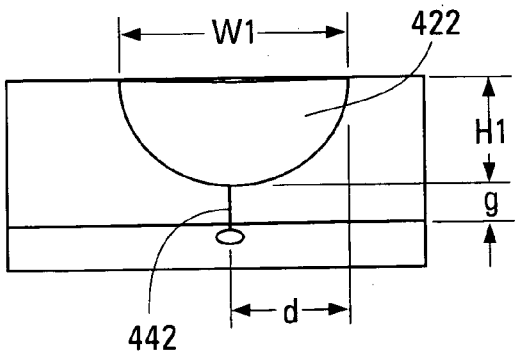
Figure 4B:
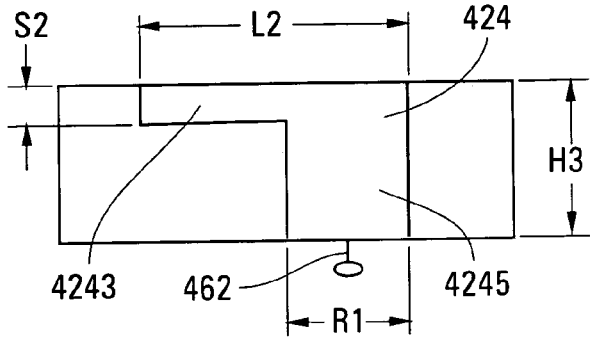

FIGS. 4A–B show exemplary embodiments provided to achieve good resonance in multiband, multi-standard, interoperable applications, wherein FIG. 4A shows an exemplary embodiment of an antenna in a 3.1 GHz to 10.6 GHz ultra-wideband application and FIG. 4B shows an exemplary embodiment of an antenna in a 2.4 GHz wireless local area network application.

To achieve a good resonance at the 3.1 GHz to 10.6 GHz ultra-wideband band, a planar radiator is provided. FIG. 4A shows an exemplary planar radiator 422 connected to a feed probe 442 above a vertical ground plane 450. In the exemplary embodiment shown in FIG. 4A, the planar radiator 422 is semi-elliptical in shape, with a smooth change in the bottom side. Due to the smooth change in the bottom side of the planar radiator, a broad band impedance transformer is created. Thus, good impedance match may be achieved across a broad bandwidth.

As shown in FIG. 4A, the planar radiator 422 has a height H1 and width W1. The height H1 and width W1 of the planar radiator 422 determine the lower edge frequency, $f_{lower1}$, of the planar radiator 422. The height H1 of the planar radiator 422 significantly controls the lower edge frequency $f_{lower1}$.

As shown in FIG. 4A, a gap g is provided between the bottom of the planar radiator 422 and the ground plane 450. The gap g significantly controls the impedance matching.

In FIG. 4A, the location of the feed point d of the feed probe 442 is around the midpoint of the bottom of the planar radiator 422. In this exemplary embodiment, the location of the feed point d also affects the impedance matching.

In this exemplary embodiment, the vertical ground plane 450 is provided for alleviating the effect of installation environment, such as the metal cover and display, on the impedance matching.

To achieve a good resonance at the 2.4 GHz wireless local area network band, for example, an inverted L-shaped radiator is provided. FIG. 4B shows an inverted L-shaped radiator 424 having a strip portion 4243 and a protrusion portion 4245 connected to feed probe 462. As shown in FIG. 4B, the radiator has a first length R1 at the protrusion portion 4245, a first height S2 at the strip portion 4243, a second height H3 at the protrusion portion 4245, and a total length L2.

Though the planar radiator design shown in FIG. 4A achieves good resonance at the 3.1 GHz to 10.6 GHz ultra-wideband band, the large-size design must be altered to meet the profile requirements for laptop computer applications. To meet the low profile requirements for laptop computer applications, in accordance with the various exemplary embodiments of this invention, the height of the planar radiator must be reduced from the height H1 typically required for the ultra-wideband applications, as shown in FIG. 4A, to a reduced height.

Furthermore, though the inverted L-shaped design shown in FIG. 4B achieves good resonance at the 2.4 GHz wireless local area network band, the large-size design must be altered to meet the profile requirements for laptop computer applications. To meet the low profile requirements for laptop computer applications, in accordance with the various exemplary embodiments of this invention, the height of the L-shaped radiator must be reduced from the height H3 typically required for wireless local area network applications, as shown in FIG. 4B, to a reduced height.

Figure 5A:
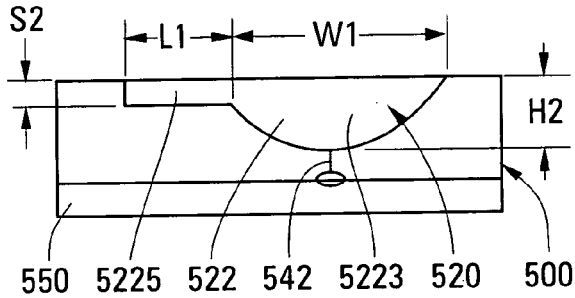
FIGS. 5A–C respectively show the front view, back view and top view detailing dimensions for a multiband antenna in accordance with an exemplary embodiment of this invention.
Figure 5B:
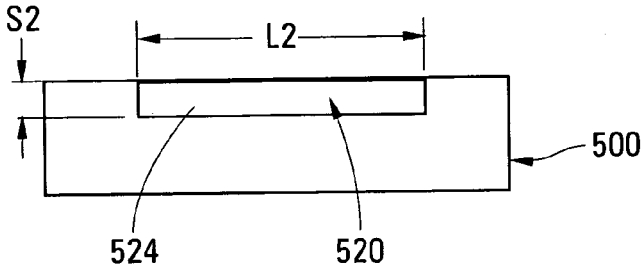
Figure 5C:
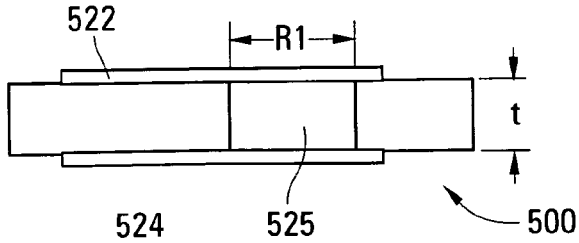

FIGS. 5A–C respectively show the front view, back view and top view detailing dimensions for a multiband antenna in accordance with an exemplary embodiment of this invention, whereby good resonance in multiband, multi-standard, interoperable applications may be achieved. As shown in FIGS. 5A–C, multiband antenna 500 includes an asymmetrical structure 520 with a front portion 522, a back portion 524, and a connecting portion 525 connecting the front portion 522 to the back portion 524, a vertical ground plane 550, and a feed probe 542. As shown in the figures, the asymmetrical structure 520 is connected to the feed probe 542 above the ground plane 550.

As shown in FIG. 5A, the front portion 522 includes a primary portion 5223, such as a semi-elliptical portion, and a strip portion 5225 attached thereto, whereby the primary portion 5223 has a width W2 and height H2, and the strip portion 5225 has a length L1 and a height S1.

In accordance with the various exemplary embodiments of this invention, as shown in FIG. 5A, for example, the height of the primary portion 5223 is reduced from the height H1 of the planar radiator 422 shown in FIG. 4A, to a reduced height H2, whereby the reduced height H2 is less than the height H1.

The reduction in height from height H1 to the reduced height H2 results in a higher lower edge frequency $f_{lower2}$ for the front portion 522 of FIG. 5A than the lower edge frequency $f_{lower1}$ of the planar radiator 422 of FIG. 4A. Accordingly, in accordance to the various exemplary embodiments of this invention, to maintain the lower edge frequency $f_{lower2}$ the same as the lower edge frequency $f_{lower1}$ prior to height reduction, as shown in FIG. 4A, the width W2 of the primary portion 5223 is increased from the width W1 of the planar radiator 422, and the strip portion 5225 of length L1 is added to the primary portion 5223. In these exemplary embodiments, the height S1 of the strip portion 5225 has a slight effect on the lower edge frequency $f_{lower2}$. Further, the sum of the length L1 of the strip portion 5225, the distance W2/2 from the edge of the primary portion 5223 to the center, and the height H2 of the primary portion 5223 mainly control the lower edge frequency $f_{lower2}$ of the front portion 522.

As shown in FIG. 5B, the back portion 524 includes a strip portion having a length L2 and height S2. In accordance with the various exemplary embodiments of this invention, as shown in FIG. 5B, for example, the height of the back portion 524 is reduced from the height H3 of the inverted L-shaped radiator 424 shown in FIG. 4B, to a reduced height S2, which is merely the height of the strip portion 4243 of the inverted L-shaped radiator 424 of FIG. 4B, whereby the reduced height S2 is less than the height H3. That is, in accordance with the various exemplary embodiments of this invention, protrusion portion 4245 is omitted.

By omitting a protrusion portion from the back portion 524 of FIG. 5B, the design eliminates the connection to a feed, such as feed probe 462 to the protrusion portion 4245 of inverted L-shaped radiator 424 of FIG. 4B. Accordingly, as shown in FIG. 5C, in accordance to the various exemplary embodiments of this invention, to provide a feed to the back portion 524, a connecting portion 525 is provided to connect the front portion 522 to the back portion 524. By connecting the right end of the back portion 524 to the front portion 522 through a connecting portion 525 with width t and length R1 equal to the protrusion portion 4245, the back portion 524 may be excited by the same feed, feed probe 442, as the front portion 522.

In these exemplary embodiments, the dimension of sum of the difference between the length L2 of the back portion 524 and the length R1 of the connecting portion, and the height H1 of the semi-elliptical radiator 422 of prior to reduction determines the lower resonance for the 2.4 GHz wireless local area network band. Further, in these exemplary embodiments, the width t of the connecting portion 525 may have slight effect on the impedance matching.

Figure 6A:
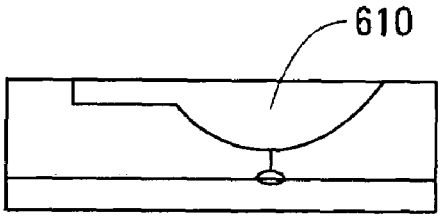
FIGS. 6A–P schematically illustrate a front view of a multiband antenna according to other various exemplary embodiments of this invention.
Figure 6B:
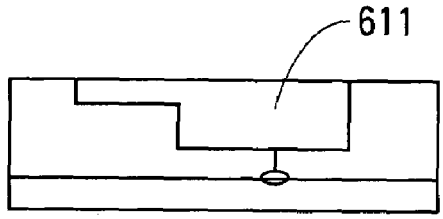
Figure 6C:
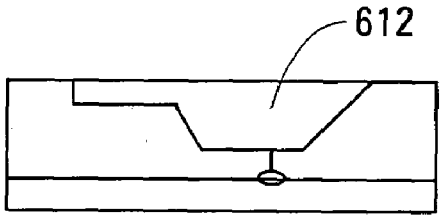

It is to be understood that the exemplary embodiments described herein are merely exemplary, and that other multiband antenna structures may be readily envisioned by one of ordinary skill in the art based on the teachings herein. For example, FIGS. 6A–P show various exemplary modification of the shapes of the front portion 522 of FIG. 5A.

Figure 6D:
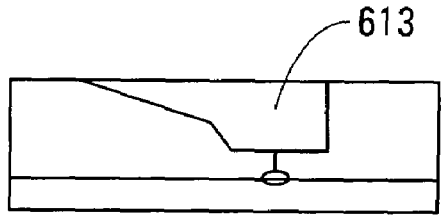
Figure 6E:
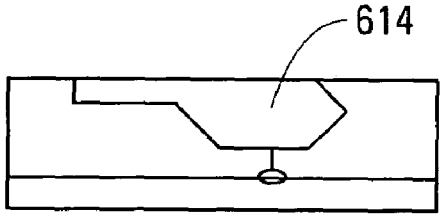
Figure 6F:
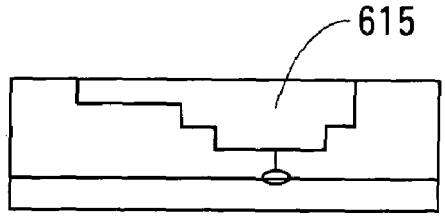
Figure 6G:
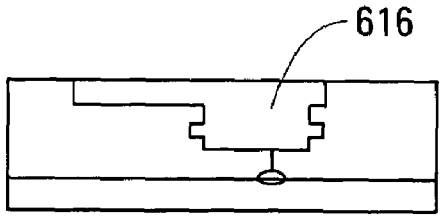
Figure 6H:
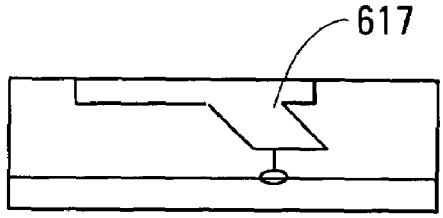
Figure 6I:
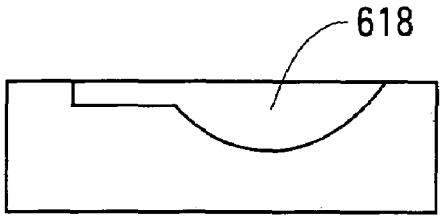
Figure 6J:
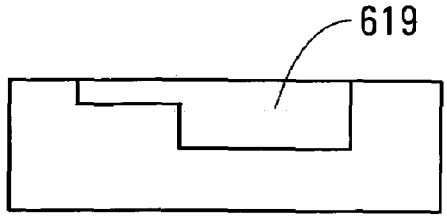
Figure 6K:
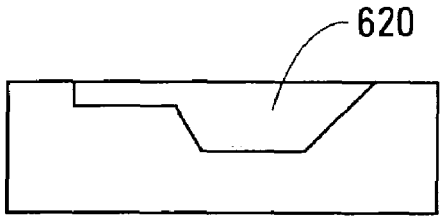
Figure 6L:
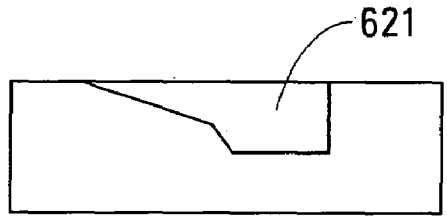

As shown in FIGS. 6B–H, J–L and N–P, the asymmetrical structure is not limited to a semi-elliptical shape, and that the primary portion 5223 may be replaced with other various shaped portions 611–617, 619–621 and 623–625. Further, as shown in FIGS. 6D, H, L and P, the other various shaped portions 613, 617, 621 and 625 are not required to be symmetrical as the primary portion 5223. Also, as shown in FIGS. 6F–H and N–P, the other various shaped portions 615–617 and 623–625 are not required to have smooth edges as the primary portion 5223.

Figure 6M:
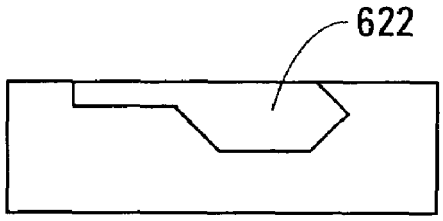
Figure 6N:
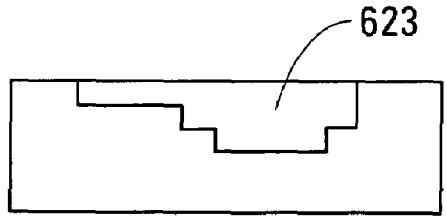
Figure 6O:
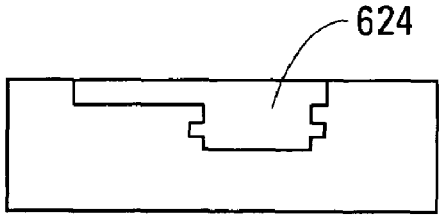
Figure 6P:
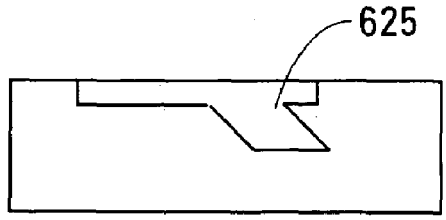

Furthermore, it should be appreciated that, in accordance with the various exemplary embodiments of this invention, the dimensions of the primary portion 5223 and the strip portion 5225 are in no way limited to the dimensions shown in FIG. 5A. That is, as shown in FIG. 6A, for example, the length of the protrusion portion of front portion 610 may be longer than length L1 of strip portion 5225 while the width of the semi-elliptical portion of the front portion 610 may be shorter than the width W2 of the primary portion 5223. Further, as shown in FIGS. 6E and 6M, for example, the height of the strip portion of the front portion 614 and 622 may be wider than the height S1 of the strip portion 5225. Additionally, as shown in FIGS. 6D and L, for example, the strip portion of the front portion 613 and 621 is not limited to having a constant height as the strip portion 5225.

Additionally, it should be appreciated that the semi-elliptical portion is not limited to a solid structure, and that a hollow structure may be provided. As shown in FIG. 6I, for example, the front portion 618 may include a semi-elliptical portion having a hollow recess internal to the portion.

It should also be appreciated that, in the various exemplary embodiments of this invention, the vertical ground plane 550 may be omitted. As shown in FIGS. 6I–P, for example, front portion 618–625 may be provided without a vertical ground plane.

It should be appreciated that the exemplary multiband antenna described herein may be implemented using multi-layered printed circuit boards. For instance, a printed circuit board comprising a planar substrate with thin metallic layers on opposite sides of the substrate may be used for constructing the multiband antenna according to the invention. In such cases, a connecting via may be formed through the substrate to connect the various antenna elements. With printed circuit board implementations, the exemplary antenna dimensions and tuning parameters would be modified to account for the dielectric constant of the substrate.

Although illustrative embodiments have been described herein with reference to the accompanying drawings, it is to be understood that the present invention is not limited to those precise embodiments, and that various other changes and modifications may be affected therein by one skilled in the art without departing from the scope of the invention.

What is claimed is:

1. A multiband antenna, comprising:

a substrate having a front side and a back side; and an asymmetrical structure provided on the fornt side and the back side of the substrate, wherein the asymmetrical structure comprises:

a primary portion and a first strip portion connected to the primary portion provided on the front side, wherein the primary portion and the first strip portion cover 3.1 GHz to 10.6 GHz ultra-wideband applications; and a second strip provided on the back side.

2. The multiband antenna of claim 1, wherein the multiband antenna provides multi-standard, interoperable operation.

3. A multiband antenna, comprising:

a substrate having a front side and a back side; and an asymmetrical structure provided on the fornt side and the back side of the substrate, wherein the asymmetrical structure comprises:

a primary portion and a first strip portion connected to the primary portion provided on the front side; and a second strip provided on the back side, wherein the second strip portion covers 2.4 GHz wireless local area network applications.

4. A multiband antenna, comprising:

a substrate having a front side and a back side;

an asymmetrical structure provided on the fornt side and the back side of the substrate, wherein the asymmetrical structure comprises a primary portion and a first strip portion connected to the primary portion provided on the front side and a second strip provided on the back side; and a vertical ground plane provided below the primary portion.

5. The multiband antenna of claim 4, further comprising a feed connected to the primary portion.

6. The multiband antenna of claim 4, further comprising a connecting portion that connects the second strip portion to the primary portion.

7. A wireless device having the multiband antenna of claim 4 integrally formed therein for wireless communication.

8. The multiband antenna of claim 4, further comprising a horizontal ground plane, extending at an angle of about 90 degrees from the vertical ground plane.

9. A portable device having a multiband antenna integrally formed on a display unit of the portable device, wherein the multiband antenna comprises:

a substrate having a front side and a back side; and an asymmetrical structure provided on the front side and the back side of the substrate, wherein the asymmetrical structure comprises:

a primary portion and a first strip portion connected to the primary portion provided on the front side; and a second strip provided on the back side.

10. The portable device of claim 9, wherein the portable device comprises one of a portable laptop computer and a cellular phone.

11. A multiband antenna, comprising:

a substrate; and an asymmetrical structure provided on the substrate, wherein the asymmetrical structure comprises a primary portion and a frontside strip portion connected to the primary portion provided on a front side of the substrate, wherein the primary portion and the frontside strip portion cover 3.1 GHz to 10.6 GHz ultra-wideband applications.

12. A multiband antenna, comprising:

a substrate; and an asymmetrical structure provided on the substrate, wherein the asymmetrical structure comprises a primary portion and a frontside strip portion connected to the primary portion provided on a front side of the substrate, wherein the backside strip portion covers 2.4 GHz wireless local area network applications.

13. A multiband antenna, comprising:

a substrate;

an asymmetrical structure provided on the substrate, wherein the asymmetrical structure comprises a primary portion and a frontside strip portion connected to the primary portion provided on a front side of the substrate; and a vertical ground plane provided below the primary position.

14. The multiband antenna of claim 13, further comprising a feed connected to the primary position.

15. The multiband antenna of claim 13, further comprising a horizontal ground plane, extending at an angle of about 90 degrees from the vertical ground plane.

* * * * *